US005174575A

United States Patent [19]

Leith et al.

[11] Patent Number: 5,174,575

[45] Date of Patent: Dec. 29, 1992

[54] GOLF CLUB SWING TRAINING DEVICE

[75] Inventors: Dale C. Leith; David W. Cowger, both of Sarasota, Fla.

[73] Assignee: Strike-Rite Golf Products, Inc., Tampa, Fla.

[21] Appl. No.: 835,297

[22] Filed: Feb. 13, 1992

[51] Int. Cl.[5] ..... A63B 69/36

[52] U.S. Cl. ..... 273/187.2; 273/191 B; 273/189 R

[58] Field of Search ..... 273/183 B, 191 B, 183 D, 273/189 R, 189 A, 188 R, 190 B, 192

[56] References Cited

U.S. PATENT DOCUMENTS

| | | | |
|---|---|---|---|
| 2,103,502 | 12/1937 | Webster | 273/191 B |
| 3,858,881 | 1/1975 | Hurwitz | 273/189 R X |
| 3,985,364 | 10/1976 | Brady | 273/183 B |
| 4,181,310 | 1/1980 | Boehmer | 273/191 B X |
| 4,662,640 | 5/1987 | Grander | 273/191 B X |
| 5,096,199 | 3/1992 | Wyatt et al. | 273/189 R |

*Primary Examiner*—George J. Marlo

[57] ABSTRACT

A harness worn by a golfer while making practice swings restricts the golfer's arm and hand movement so that the hands of the golfer pass through the impact plane before the clubhead strikes the golf ball. In a first embodiment, a flexible strap extends from a point on the shaft of the golf club just above the clubhead to a point on the golfer's forearm. In a second embodiment, a rigid rod replaces the flexible strap. In both embodiments, the effective length of the strap or rod is adjustable to constrain the golfer's movement as needed. The point on the golfer's forearm may be defined by a rigid mounting member that is carried by a base plate that is positioned within a housing and the housing is strapped to the golfer's forearm by a plurality of adjustable straps. It may also be defined by a pivotally mounted mounting member that is secured to an exterior surface of the housing. The housing is held into position by a flexible strap that is connected to an adjustable length strap that encircles the golfer's upper arm.

14 Claims, 5 Drawing Sheets

GOLF CLUB SWING TRAINING DEVICE

TECHNICAL FIELD

This invention relates, generally, to devices of the type worn by golfers when practicing their golf swing. More particularly, it relates to a restraint that ensures that the golfer's wrists will pass through the plane of impact before the golf clubhead strikes a golf ball.

BACKGROUND ART

An imaginary vertical plane that passes through a golf ball is known as the impact plane or other suitable appellation. A golfer intending to propel the ball a relatively long distance should swing the club so that his or her hands pass through the impact plane before the clubhead impacts the ball. If the hands trail the clubhead at the moment of impact, or arrive at the plane of impact at the time of impact, the resulting shot will be less satisfactory than it might have been.

An instructor might instruct a student to hold the club so that the clubhead trails the hands through the impact plane, but following such instructions is not easy for most people. Many people feel that their hands are preceding the clubhead through the impact plane even when they are not; accordingly, most attempts to compensate result in overcompensation and the swing of the golfer deteriorates.

Even when a golfer successfully executes a swing with the correct amount of lead, the muscle memory of how the swing was performed is easily lost.

What is needed, then, is a device that holds the golfer's arms and wrists in a preselected position whereby a correct swing can be executed repeatedly until the golfer's muscle memory can be relied upon to produce a proper shot when the device is not used. The prior art does not suggest that such a device should be built, so it does not contain any teachings or suggestions as to how such a device could be built. Accordingly, the teachings that follow were not obvious to those of ordinary skill in this art at the time the present invention was made.

DISCLOSURE OF INVENTION

The present invention includes two embodiments; both restrain the golfer's movement during a golf swing, but the first embodiment restricts said movement less than the second embodiment. In the first embodiment, a flexible interconnecting member extends between the golfclub, from a point just above the clubhead, to the golfer's forearm. The length of the interconnecting member is shortened until the golfer's trailing arm (the left arm for a left-handed golfer and the right arm for a right-handed golfer) and the clubhead are spaced apart from one another by a predetermined distance when the club is gripped in a normal grip. The predetermined distance is selected so that when the golfer swings, his or her hands will precede the clubhead through the impact plane. The flexible interconnecting means is inelastic; accordingly, it prevents the golfer's wrists from bending away from the trailing forearm during the swing but does not prevent the wrists from moving toward the clubhead.

In the second embodiment, the adjustable-length interconnecting member is rigid; it prevents the golfer's wrists from bending either toward or away from the clubhead.

The primary object of the invention is to provide an inexpensive device that can be easily worn by a golfer during practice and which substantially improves the golfer's swing by holding the golfer's arms and wrists in an optimal position during practice swings so that a muscle memory of a properly executed swing can be established.

Another object is to provide such device in a light-inweight form so that its weight does not have any significant effect on the golfer's swing.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar reference parts throughout the several views of the drawings.

BEST MODES FOR CARRYING OUT THE INVENTION

Figure 1:
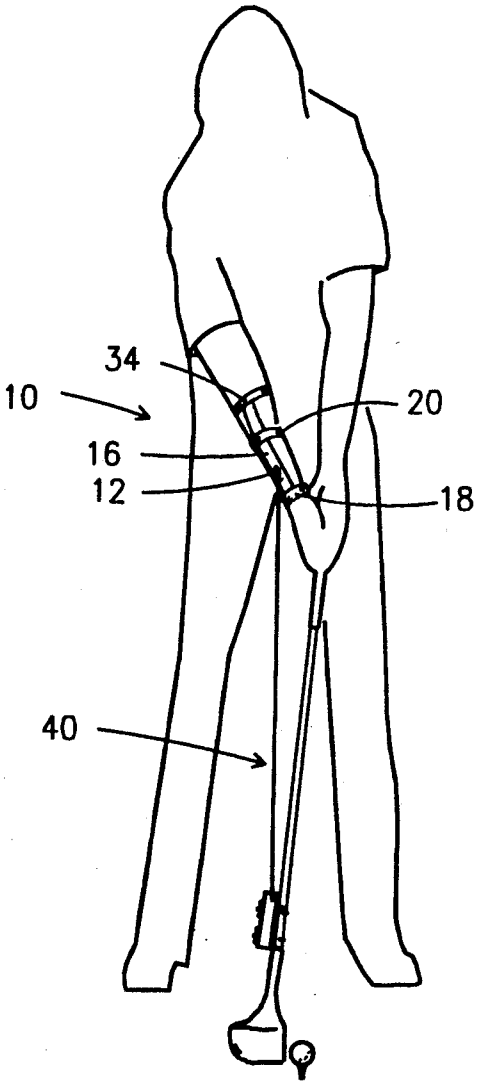
FIG. 1 is a perspective view of a golfer wearing the novel restraint at the beginning of a golf swing.
Figures 6, 7:
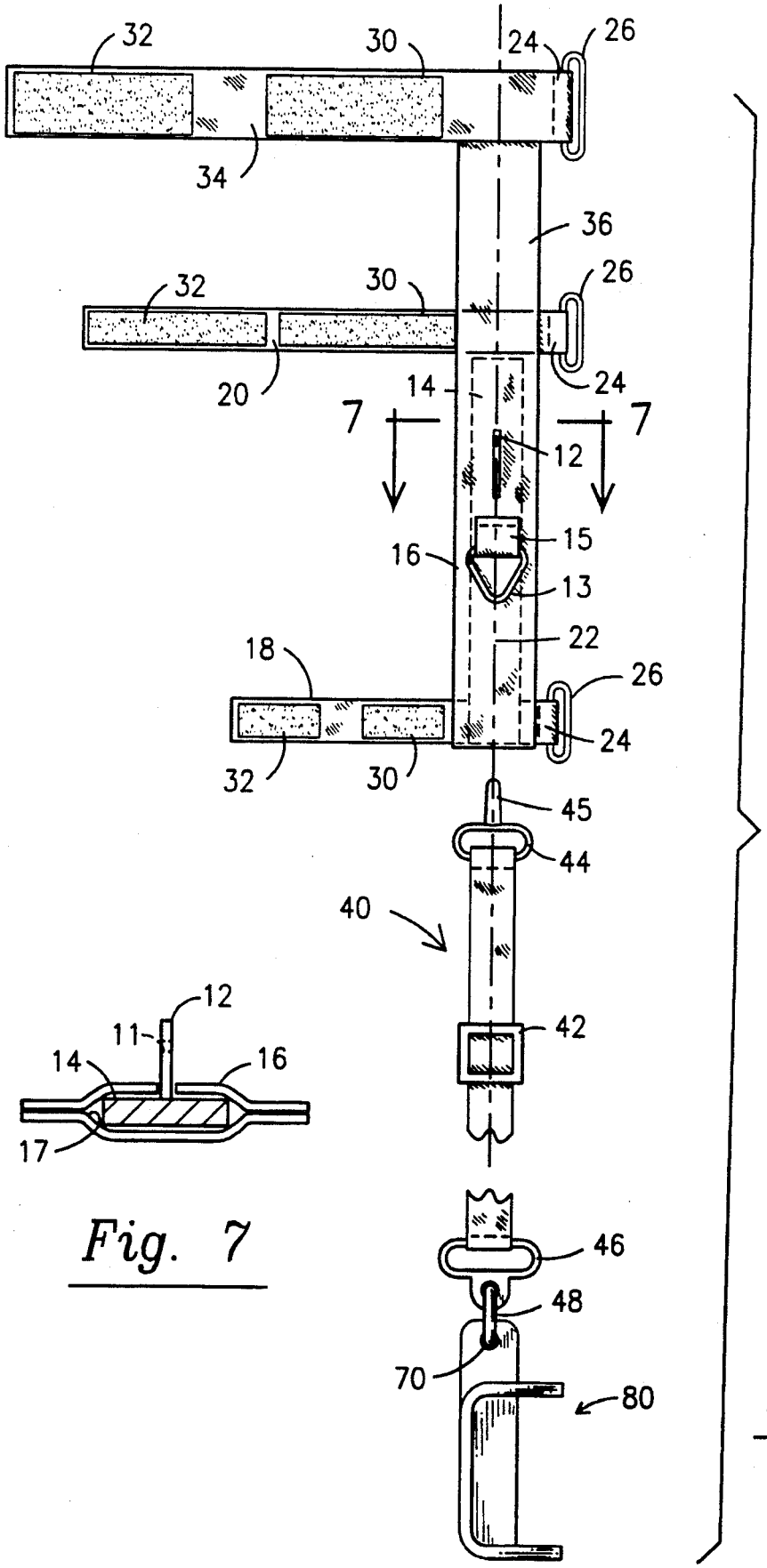
FIG. 6 is an exploded top plan view of the part of the harness that is secured to the golfer's forearm and the flexible interconnecting member.
FIG. 7 is a sectional view taken along line 7—7 in FIG. 6.

Referring now to FIG. 1, it will there be seen that the novel restraint is denoted as a whole by the reference numeral 10. Base member 12, as perhaps best shown in FIGS. 6 and 7, is a flat, rigid member and is fixedly secured by suitable means to elongate base plate 14 in orthogonal relation thereto. Base plate 14 is also made of a rigid material; it is positioned and held within housing 16 which is preferably made of fabric for the comfort of the golfer. More particularly, a pocket 17 (FIG. 7) is formed in the housing and base plate 14 is positioned in that pocket; the peripheral borders of the pocket are sewn around the base plate to hold it against movement.

Housing 16 is positioned in overlaying relation to the golfer's trailing forearm as shown in FIGS. 1, 2, 8, and 9 and straps 18, 20 are employed to hold it in said position. Strap 18 is secured to the leading end of housing 16 and strap 20 is secured to the trailing end therefrom; both straps extend laterally with respect to the longitudinal axis 22 (FIG. 6) of housing 16 and thus may be wrapped around the golfer's forearm. More particularly, each strap includes a looped end 24 within which is captured a straight part of an oblong ring 26. Moreover, in this particular embodiment, a couple of longitudinally spaced apart strips of hook and loop fastening means such as Velcro fastening means 30, 32 are secured to the outer surface of each strap 18, 20. Velcro 30 is the hook part thereof and Velcro 32 is the loop part thereof, or vice versa. Housing 16 and hence base member 12 are thus secured in overlying relation to the appropriate forearm by wrapping each strap under said forearm, threading each strap 18, 20 through its associated ring member 26, and reversely wrapping the free end of each strap back under the forearm to bring leading fastening means 32 into overlaying engagement with trailing fastening means 30.

An auxiliary flexible strap 34 encircles the golfer's arm above the elbow and is connected to the trailing end of housing 16 by interconnecting strap 36; strap 34 is tightened to said upper arm in the same manner as straps 18, 20 are tightened to the forearm. The structural parts common to straps 18, 20, and 34 are denoted by the same reference numerals. Strap 34 prevents longitudinal travel of housing 16 and hence of base plate 12 relative to the golfer's forearm.

Figure 2:
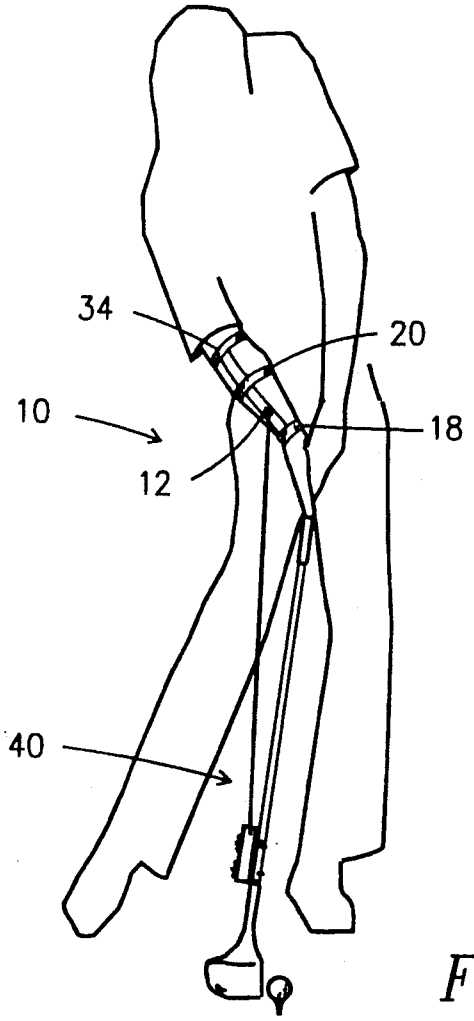
FIG. 2 is a perspective view as the golfer completes the swing.

An elongate, flexible but inelastic interconnecting means is designated 40 as a whole in FIGS. 1, 2, and 6; in one embodiment, not shown, it interconnects base member 12 and the mounting device that is secured to the golf club just above the clubhead. However, in the preferred embodiment, the flexible interconnecting means 40 is mounted to triangular member 13 instead of base member 12. Note that said triangular member 13 is loosely captured or pivotally mounted within loop 15 which is sewed to an exterior surface of housing 16. Thus, attachment of the proximal end of strap 40 to member 13 introduces more play into restraint 10 as compared to the unillustrated attachment of said strap to the rigid base member 12. In the claims that follow, the term "base member" refers to both the rigid, substantially immovable base member 12, and the pivotally mounted triangular member 13. The respective functions of base members 12 and 13 are essentially interchangeable; the rigid interconnecting means of the second embodiment could also be attached to member 13. However, the preferred arrangements are the illustrated arrangements, i.e., the proximal end of the flexible interconnecting means is mounted to triangular member 13, and the proximal end of the rigid interconnecting means is mounted to base member 12 as aforesaid.

Although numerous means are available for adjusting the length of strap 40, the embodiment of FIG. 6 includes a bar slide adjuster 42 and ring members 44, 46 at opposite ends thereof. More particularly, strap 40 is a continuous piece that is extended through said members 44, 46; the opposite ends of said strap are fed through the bar slide adjuster 42 and are held in frictional engagement. Clip 45 at the proximal end of ring 44 releasably engages triangular member 13.

Figure 3:
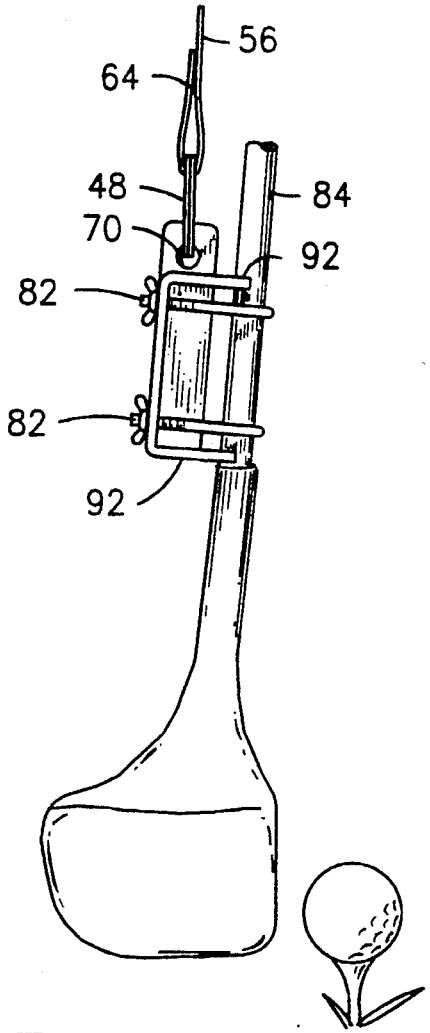
FIG. 3 is a front elevational view of the clamp part of the novel device.
Figure 4:
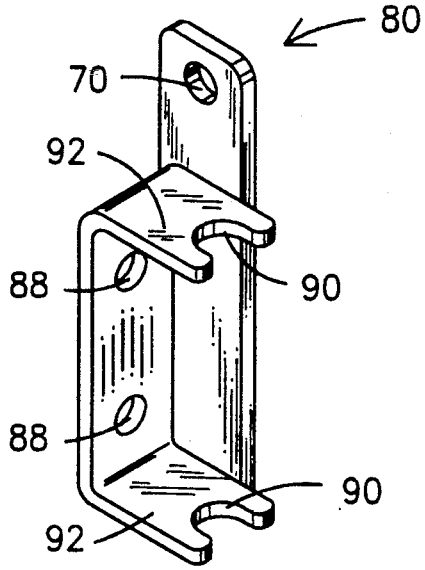
FIG. 4 is a perspective view of part of said clamp.
Figure 5:
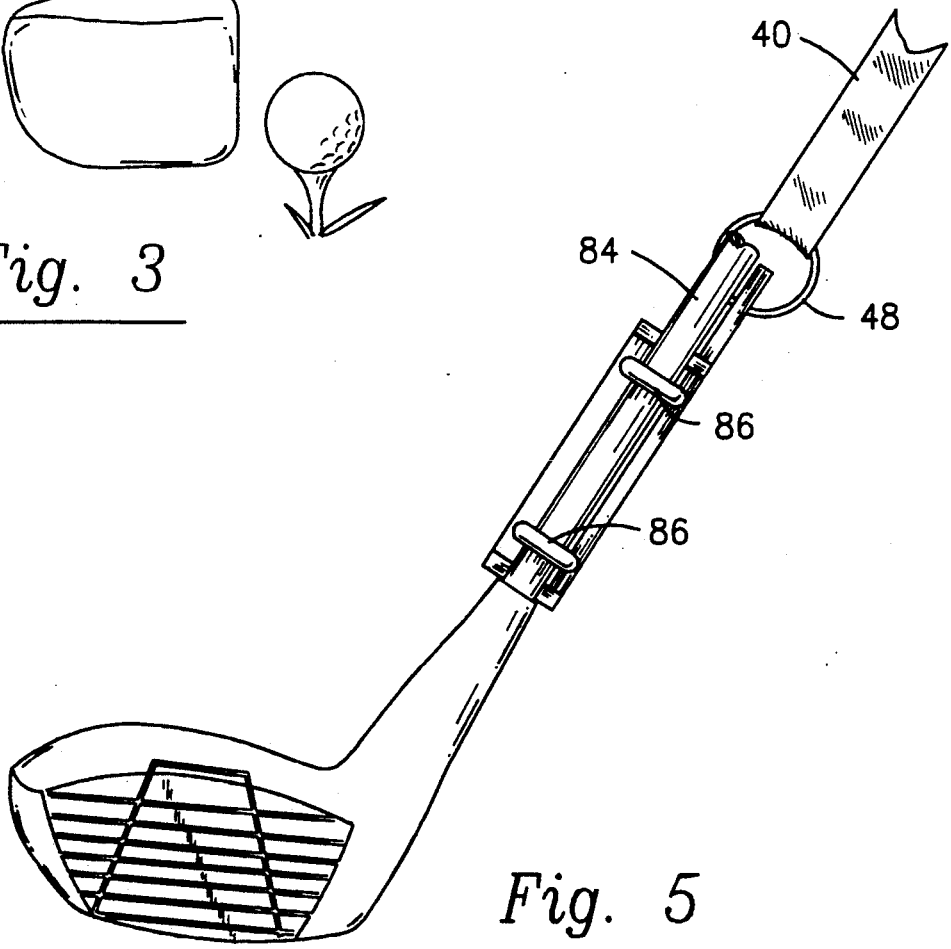
FIG. 5 is a side elevational view of said clamp.

Member 46 at the clubhead end of strap 40 captures ring 48 which is in turn captured within an aperture 70 (also see FIG. 4) formed in clamp 80 that is secured to the club shaft, just above the hosel, by a pair of screw and nut-type fastening means 82, as best shown in FIGS. 3 and 5. More specifically, shaft 84 is disposed in sandwiched relation between hooks 86 formed in fastening means 82 and said clamp 80; tightenin q the fastening means thus causes convergence of the hooks 86 and the clamp 80 so that the shaft 84 is tightly squeezed therebetween so that clamp 80 does not slip with respect to said shaft 84.

As best depicted in FIG. 4, clamp 80 has a pair of apertures 88 formed therein for receiving the fastening means 82; recesses 90 formed in spacer walls 92 accommodate the shaft 84 as perhaps best understood in connection with FIG. 3.

This particular means for clamping the lower end of elongate part 56 to the clubshaft 84 is not critical to the invention; many other suitable clamping means may be provided and all of them are within the scope of this invention.

Figure 8:
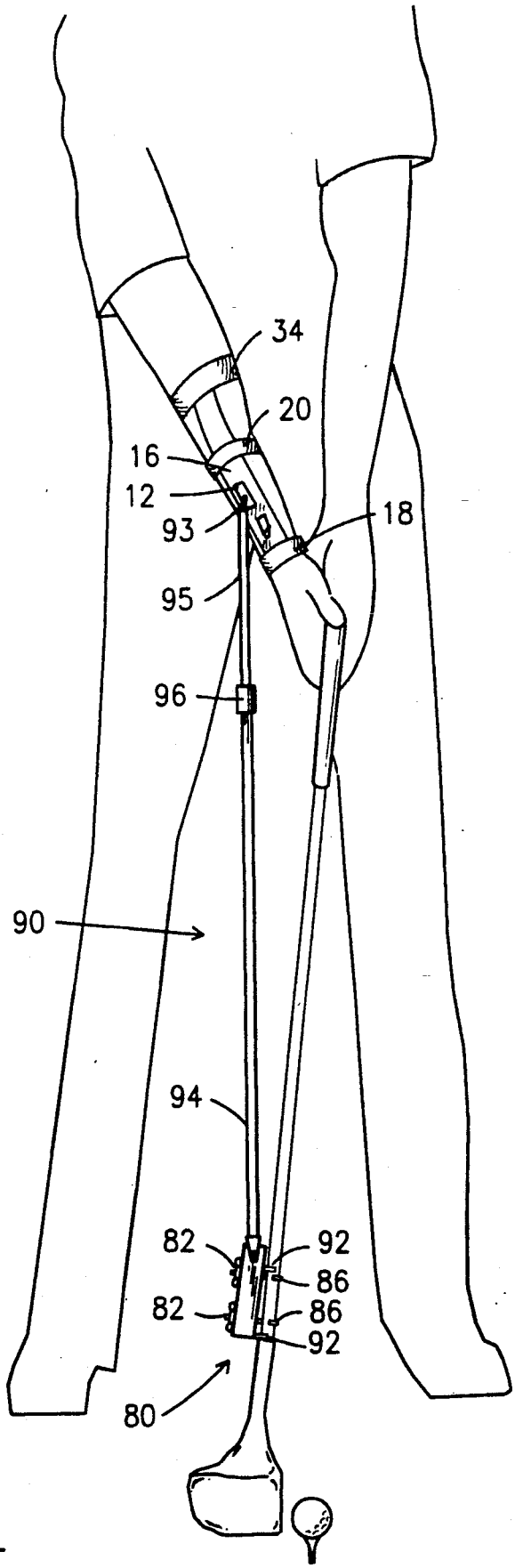
FIG. 8 is a perspective similar to FIG. 1, but showing a second embodiment of the invention.

A first variation of the second embodiment is shown in FIG. 8. It is like the first embodiment, except that interconnecting means 90 is a rigid, telescoping means having two telescoping rods 94, 95. Its rigidity restricts the movement of the golfer's wrists to a greater extent than the flexible interconnecting means 40 of the first embodiment. Joint 96 may be positioned at any location along the extent of rigid member 90, but is towards the upper end thereof to facilitate changing the length of said member 90; said joint is rotatably mounted so that the length of member 90 may be adjusted as desired when the joint is rotated and so that said member may be locked into place by a counterrotation of said joint. Other suitable telescoping means are within the scope of this invention as well.

Note that the proximal end of rod 95 is connected to rigid base plate 12 through a suitable connecting means 93.

Figure 9:
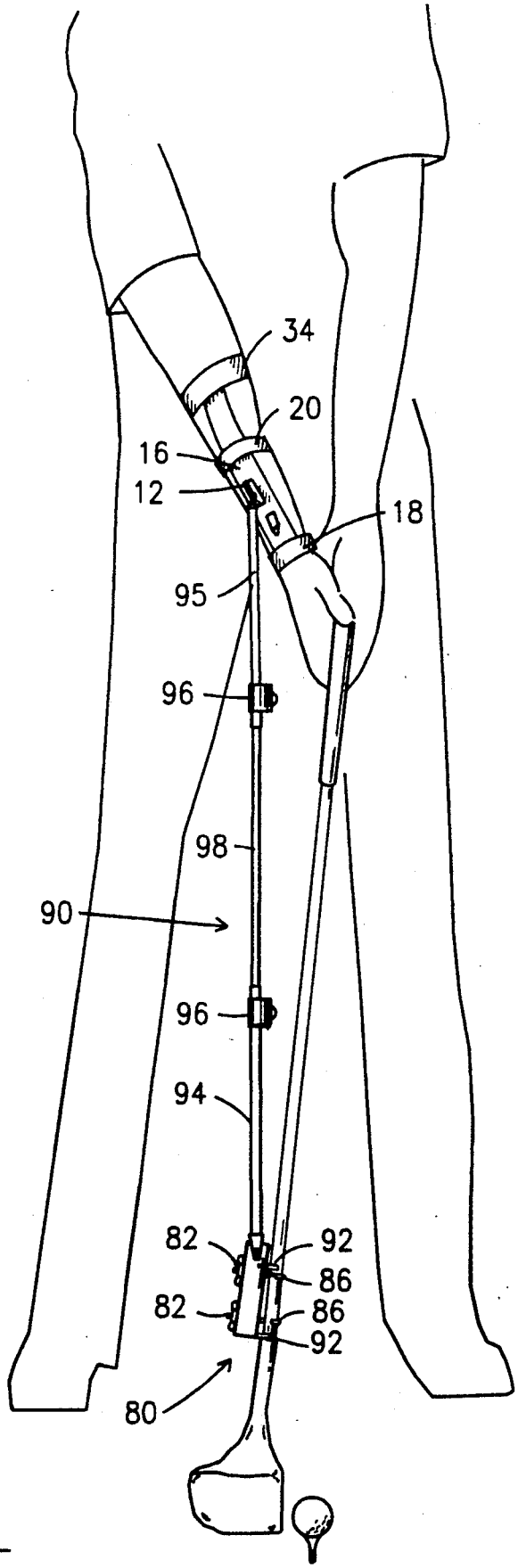
FIG. 9 is a perspective view similar to FIG. 8, showing a variation of the second embodiment.

A second variation of the second embodiment is depicted in FIG. 9. In this embodiment, a third rod 98 telescopically interconnects at its opposite ends with rods 94 and 95. This increases the range of the adjustability of rigid interconnecting means 90 so that the novel harness may be used by very short and very tall players.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A golf swing training aid comprising; a harness adapted to be worn by a golfer when practicing a golf swing;

a base member;

means for releasably securing said base member to the golfer's forearm at a preselected location between the golfer's wrist and elbow;

a golf club including a shaft and a head;

a clamp releasably secured to said golf club shaft in closely spaced relation to said golf clubhead;

a flexible interconnecting member disposed in interconnecting relation between said clamp and said base member;

the length of said interconnecting member being such as to extend between said base member and said clamp when the golfer holds the golf club in a golf ball address position, preparatory to executing a practice swing, and constrain movement of the arm of the golfer to which said base member is mounted so that the golfer's wrists will pass through the vertical plane of impact prior to the striking of a golf ball by the clubhead.

2. The harness of claim 1, further comprising an elongate, rigid base plate upon which said base member is mounted, said base plate disposed in overlaying relation to said forearm and said base member projecting substantially orthogonally therefrom.

3. The harness of claim 2, further comprising a housing member for housing said base plate.

4. The harness of claim 3, further comprising a plurality of straps for releasably securing said housing member and hence said base plate to said forearm.

5. The harness of claim 4, further comprising means for adjusting the effective length of each strap of said plurality of straps and hence the tightness of each strap of said plurality of straps relative to said forearm.

6. The harness of claim 4, further comprising a flexible upper arm strap, having an adjustable effective length, for encircling the golfer's upper arm, and a flexible interconnecting means for interconnecting said upper arm strap and said housing member for said base plate, said upper arm strap serving to inhibit sliding displacement of said housing member and hence of said base plate and said base member with respect to said forearm.

7. The harness of claim 1, further comprising a housing member to which said base member is secured, a plurality of straps for releasably securing said housing member and hence said base member to said forearm, and means for adjusting the length of each strap of said plurality of straps.

8. The harness of claim 7, further comprising a flexible upper arm strap, having an adjustable effective length, for encircling the golfer's upper arm, and a flexible interconnecting means for interconnecting said upper arm strap and said housing member, said upper arm strap serving to inhibit sliding displacement of said housing member and said base member with respect to said forearm.

9. A golf swing training aid comprising: a harness adapted to be worn by a golfer when practicing a golf swing;

a base member;

means for releasably securing said base member to the golfer's forearm at a preselected location between the golfer's wrist and elbow;

a clamp releasably secured to a golf club shaft in closely spaced relation to a golf clubhead;

a rigid interconnecting member disposed in interconnecting relation between said clamp and said base member;

adjustment means for adjusting the length of said interconnecting member so that when the golfer holds the golf club preparatory to executing a practice swing, the arm of the golfer to which said mounting member is mounted is constrained in its movement;

whereby the constraint placed upon said forearm ensures that the golfer's wrists will pass through the plane of impact prior to the striking of a golf ball by the clubhead.

10. The harness of claim 9, further comprising an elongate, rigid base plate upon which said base member is mounted, said base plate disposed in overlaying relation to said forearm and said base member projecting substantially orthogonally therefrom.

11. The harness of claim 10, further comprising a housing member for housing said base plate.

12. The harness of claim 11, further comprising a plurality of straps for releasably securing said housing member and hence said base plate to said forearm.

13. The harness of claim 12, further comprising means for adjusting the effective length of each strap of said plurality of straps and hence the tightness of each strap of said plurality of straps relative to said forearm.

14. The harness of claim 13, further comprising a flexible upper arm strap, having an adjustable effective length, for encircling the golfer's upper arm, and a flexible interconnecting means for interconnecting said upper arm strap and said housing member, said upper arm strap serving to inhibit sliding displacement of said housing member and hence of said base plate and said mounting member with respect to said forearm.

* * * * *